US005678634A

United States Patent [19]

Rehbock et al.

[11] Patent Number: 5,678,634

[45] Date of Patent: Oct. 21, 1997

[54] METHOD AND APPARATUS FOR RETRIEVING A WHIPSTOCK

[75] Inventors: Hans H. Rehbock; Gerald Lynde, both of Houston; Ed Lueders, Stafford; Bryan Franklin McKinley; John J. Johnson, both of Houston; Greg Nazzal, Kingwood, all of Tex.

[73] Assignee: Baker Hughes Incorporated, Houston, Tex.

[21] Appl. No.: 544,371

[22] Filed: Oct. 17, 1995

[51] Int. Cl.[6] ..... E21B 23/00

[52] U.S. Cl. ..... 166/377; 166/117.6; 166/381; 175/79

[58] Field of Search ..... 166/117.6, 117.5, 166/382, 381, 377; 175/79, 80, 81, 82

[56] References Cited

U.S. PATENT DOCUMENTS

| | | | |
|---|---|---|---|
| 2,132,061 | 10/1938 | Walker | 166/117.6 |
| 4,153,109 | 5/1979 | Szescila | 166/250 |
| 4,765,404 | 8/1988 | Bailey et al. | 166/117.6 |
| 5,109,924 | 5/1992 | Jurgens et al. | 166/117.5 |
| 5,193,620 | 3/1993 | Braddick | 166/382 |
| 5,287,921 | 2/1994 | Blount et al. | 166/117.6 |
| 5,335,737 | 8/1994 | Baugh | 175/61 |
| 5,341,873 | 8/1994 | Carter et al. | 166/117.5 |
| 5,398,754 | 3/1995 | Dinhoble | 175/81 X |
| 5,427,179 | 6/1995 | Bailey et al. | 166/117.6 |
| 5,443,129 | 8/1995 | Bailey et al. | 175/45 |
| 5,467,819 | 11/1995 | Braddick | 166/117.6 |
| 5,499,680 | 3/1996 | Walter et al. | 166/117.6 X |
| 5,535,822 | 7/1996 | Schock et al. | 166/117.6 X |

FOREIGN PATENT DOCUMENTS

3832715 A1 3/1990 Germany .

OTHER PUBLICATIONS

Weatherford Fishing and Rental Tool Services Catalog, Weatherford International Incorporated, 1993, 4 pages.

Lebus Rotary Tool Works, Inc., Composite Catalog, Lebus Type GP Joint Tripping and Removable Whipstock, Type GP Whipstock—Setting Operations, date unknown, 2 pages.

Miscellaneous literature, Gator Retrievable Whipstocks, Gator Manufacturing Company, date unknown, 1 page.

Introducing Christensen Window Cutting Services Catalog, Christensen Diamond Products Division, date unknown, 7 pages.

Miscellaneous literature, Baker Packers Completion Systems, Model DW-1 Whipstock Anchor/Packer System, 1 page.

Miscellaneous literature, Retrievable Whipstock, Baker Oil Tools, Jun., 1993, 10 pages.

(List continued on next page.)

[57] ABSTRACT

A retrieval tool for whipstocks is disclosed. A latch is retractable into the tool upon application of hydraulic pressure. A locking pin securely fastens the whipstock and retrieving tool together. The hydraulic pressure acts a cleaning force on the top of the whipstock and the retrieving slot to facilitate engagement. The offset stabilizer, when oriented opposite the lug on the retrieving tool, creates a force in the direction of the lug, whereby latching the retrieving tool will start. A joint of drillpipe or heavyweight drillpipe is run above the eccentric stabilizer. An offset stabilizer is provided to ensure proper initial orientation and avoid sticking the tool. The latch can firmly grip lugs within a slot in the whipstock. A overshot design is also disclosed using a similar hydraulically actuated latch assembly where the latch grabs the whipstock without having to use an opening therein, if for any reason the opening has been fouled with debris or damaged due to milling. Generally, release from the whipstock cannot occur unless hydraulic pressure is reapplied to release the latch and locking pin, thus allowing them to retract toward the body of the retrieval tool.

39 Claims, 8 Drawing Sheets

OTHER PUBLICATIONS

Retrieve It . . . In One Trip, A–Z/Grant's Anchor–Stock/Sidetrack System is retrievable in one trip!, American Oil & Gas Reporter, Sep. 1993, 3 pages.
A–Z/Grant International Casing Sidetrack Systems Catalog, date unknown, 7 pages.
Greg Nazzal, et al., Casing Exit Options: Methods and New Technology, Caspiyneftegas–94, Sep. 21, 1994, held in Baku, Russia, pp. 1–9.
WindowMaster, Third Edition, Apr. 1994, Baker Hughes Inteq, pp. 1–31.
Miscellaneous literature, Success is something you can prove, Weatherford, date unknown, 2 pages.

*Primary Examiner*—Hoang C. Dang
*Attorney, Agent, or Firm*—Rosenblatt & Redano P.C.

METHOD AND APPARATUS FOR RETRIEVING A WHIPSTOCK

FIELD OF THE INVENTION

The field of this invention relates to techniques for retrieval of whipstocks.

BACKGROUND OF THE INVENTION

In the past, when it has been desired to create a side track wellbore from a main wellbore, an orienting tool such as a whipstock has been used. The whipstock is positioned in the main wellbore and has a generally tapered appearance to direct a starter mill or other mills toward a casing for milling of a window, and ultimately the drilling of the deviated wellbore. The working surface of the whipstock is arcuate so that it can properly guide the mill or mills toward the casing for the cutting of the window. Prior whipstock designs have also had flow passages therethrough to facilitate subsequent production through the whipstock from the main wellbore. Up until recently, whipstocks have been left in the main wellbore and have not been retrievable.

There are particular difficulties in retrieving whipstocks because of the thin cross-section at the very top. The milling operation for the window in the casing results in the creation of debris whose presence further creates difficulties in getting a grip on a whipstock with a retrieving tool to remove it from the wellbore.

While milling techniques have improved so that one-trip milling of a window with a whipstock has been accomplished as illustrated in Jurgens U.S. Pat. No. 5,109,124, techniques for retrieval of whipstocks have been more slow to develop. Recently, a key type design has been developed by Weathefford which has an opening adjacent the top of the whipstock and a retrieval tool with a protruding member which is insertable in the opening at the top of the whipstock whereupon the whipstock, if properly caught, could be removed. This product is illustrated in U.S. Pat. No. 5,341,873 (Carter). However, this design presented several complexities which greatly increased the prospect that the whipstock would not be retrieved. First, the lug or protruding component which was to be inserted into the opening in the top of the whipstock was exposed at the bottom of the retrieving tool. Accordingly, on the way down in the wellbore should the retrieving tool strike the casing or some other object, the lug could get bent or misshapen preventing its entry into the opening in the whipstock. Secondly, if due to the milling operation foreign matter were to enter the area around the opening in the whipstock, the retrieving tool of the prior design would be unable to make a proper entry into the opening in the whipstock for proper latching so that the whipstock could be removed. Finally, the orientation system provided was complex and the possibility existed that the retrieval tool would catch on other things apart from the opening in the whipstock. If this happened, the operations personnel at the surface would not have any firm knowledge as to whether they had latched into the whipstock and it just would not come out, or that the tool had latched onto some other protrusion or obstruction in the wellbore.

Accordingly, the apparatus and method of the present invention have been developed with several objectives in mind. First, a simple offset stabilizer design has been provided to facilitate proper initial orientation. Second, a retractable latch mechanism has been devised which works in tandem with a circulation system so that the debris or any other contaminants adjacent the top of the whipstock are swept cleanly away prior to an attempt to latch onto the whipstock. Third, the latch mechanism has been provided to firmly grip the whipstock and to retain the grip to a slot in the whipstock as the whipstock is being retrieved. Finally, with a variant of the latch mechanism, a whipstock can be retrieved even if the slot within the whipstock has been fouled with debris or damaged in the milling operation. These and other objectives will become more clear upon review of a detailed description of the apparatus and method.

SUMMARY OF THE INVENTION

A retrieval tool for whipstocks is disclosed. A latch is retractable into the tool upon application of hydraulic pressure. A locking pin securely fastens the whipstock and retrieving tool together. The hydraulic pressure acts a cleaning force on the top of the whipstock and the retrieving slot to facilitate engagement. The offset stabilizer, when oriented opposite the lug on the retrieving tool, creates a force in the direction of the lug, whereby latching the retrieving tool will start. A joint of drillpipe or heavyweight drillpipe is run above the eccentric stabilizer. An offset stabilizer is provided to ensure proper initial orientation and avoid sticking the tool. The latch can firmly grip lugs within a slot in the whipstock. A overshot design is also disclosed using a similar hydraulically actuated latch assembly where the latch grabs the whipstock without having to use an opening therein, if for any reason the opening has been fouled with debris or damaged due to milling. Generally, release from the whipstock cannot occur unless hydraulic pressure is reapplied to release the latch and locking pin, thus allowing them to retract toward the body of the retrieval tool.

DETAILED DESCRIPTION OF THE PREFERRED EMBODIMENT

Figure 5:
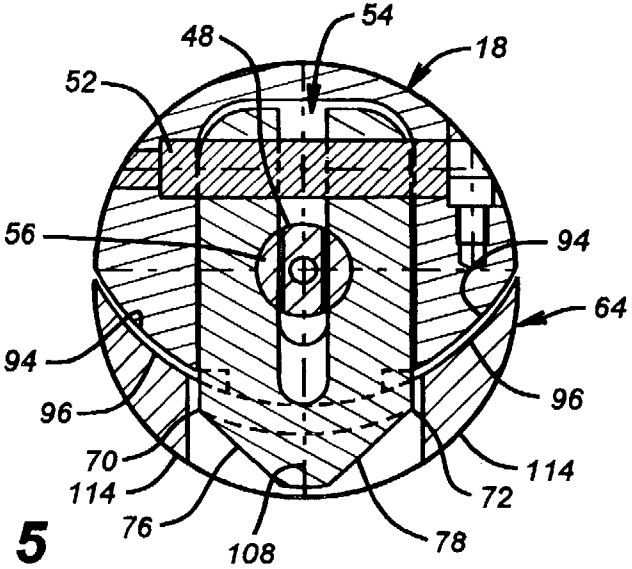
FIG. 5 is a sectional view of the retrieving tool aligned with the whipstock with the latch engaged in the opening of the whipstock.

The apparatus A of the present invention is illustrated in FIGS. 1*a–d*. A top sub 10 has a thread 12 to which a tubing string (not shown) can be connected for proper positioning of the apparatus A in the wellbore. Top sub 10 has a bore 14 which extends into flow bore 16 (see FIG. 1*c*) within the body 18. Top sub 10 is connected to body 18 at thread 20. Bore 16 continues through piston 22. Piston 22 has a rounded upper end 24 which is guided by guide 26. Guide 26 is secured to the body 18 at thread 28. Spring 30 bears on guide 26 at one end and on shoulder 32 at the other end. A variable volume cavity 34 is formed between the body 18 and the rounded central portion 36 of the piston 22. Piston 22 has a lower end 48 which has a square or rectangular profile. The latch 50 is mounted at pivot 52. Pivot 52 is secured to the body 18. Pivot 52 is also illustrated in FIG. 5 where it is clearer to see that the latch 50 has a U-shaped slot 54 with the lower end 48 of piston 22 extending therethrough. As better seen in FIG. 1*d*, the lower end 48 of piston 22 has a pair of lugs, one of which 56 is visible in FIG. 1*d*. The lugs 56 and 58 are more easily seen in FIG. 5. Thus, when the piston 22 is retracted by the application of fluid pressure in variable volume cavity 34, the piston 22 compresses the spring 30 translating the piston 22 uphole where lugs 56 and 58 pivot latch 50 about pivot 52 to the position shown in FIG. 1*d*.

Conversely, when fluid pressure is removed from cavity 34, spring 30 pushes piston 22 downhole toward nozzle 60. At that time, a set of raised surfaces or lugs, one of which is visible as dashed line 62, which are disposed on the lower end 48 of piston 22 bear on latch 50 to rotate it in a counterclockwise direction about pivot 52 until latch 50 stops on surface 90 of a cutout in body 18. In essence, lugs 56 and 58 and opposed lugs 62 create a groove on piston 22 which during assembly is disposed in slot 54 of latch 50.

Figure 1A:
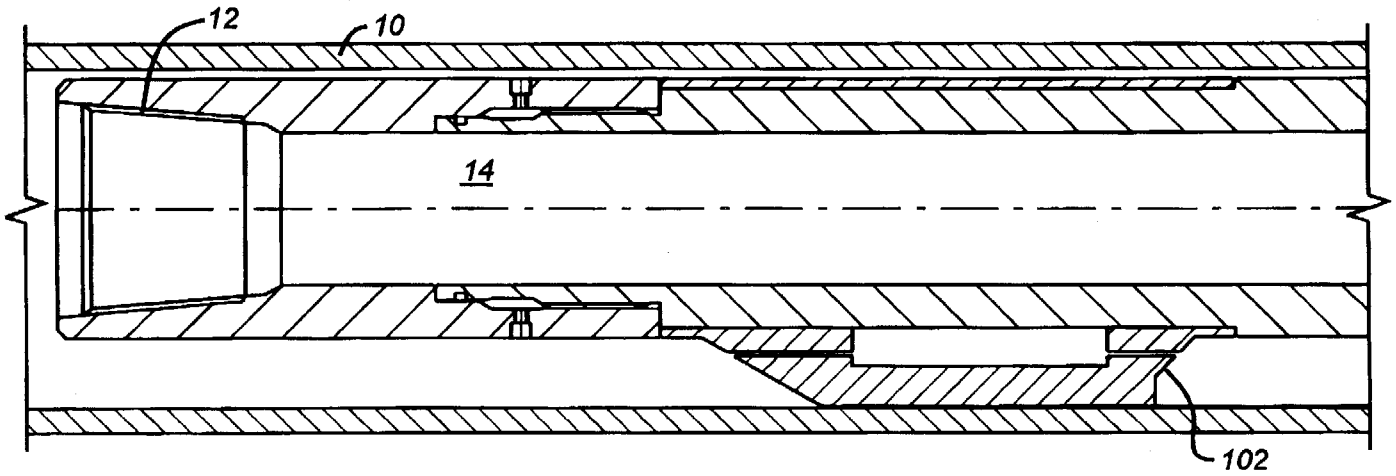
FIGS. 1*a–d* illustrate the retrieval tool in sectional elevational view with the latch and pin retracted toward the body of the retrieving tool.
Figure 1B:
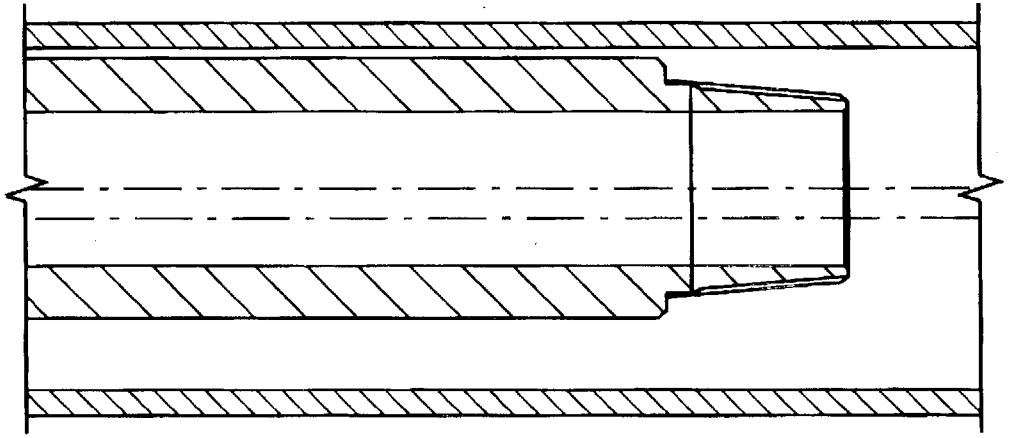
Figure 1C:
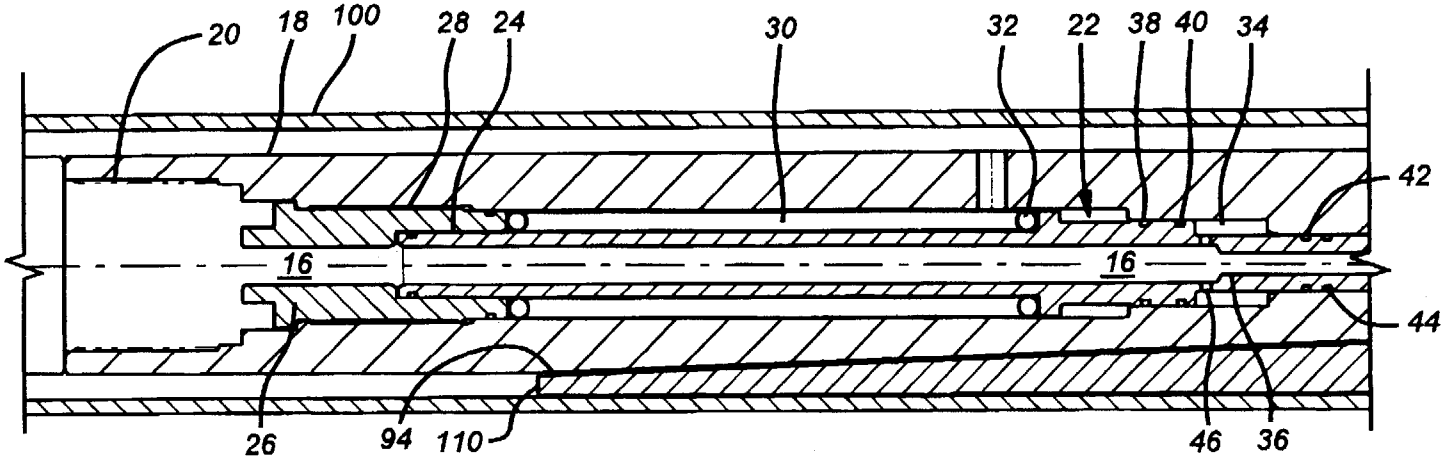
Figure 1D:
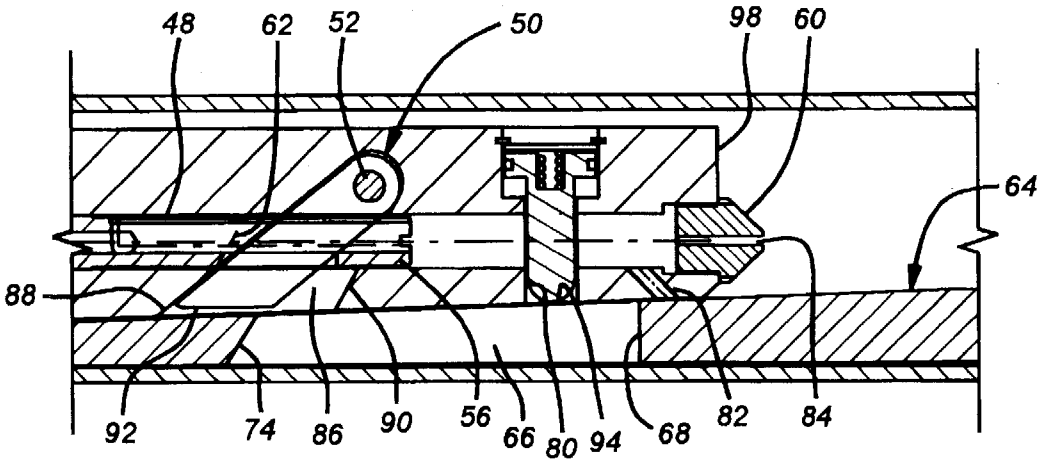
Figure 2A:
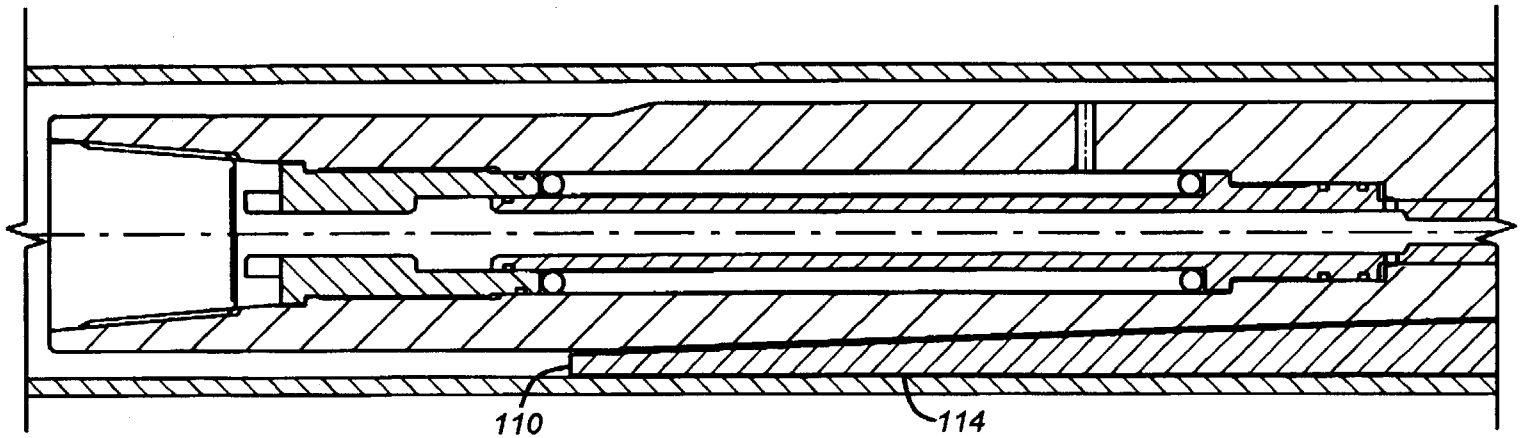
FIGS. 2*a–b* illustrate the tool of FIGS. 1*c–d* in the latch area with the latch and pin engaged into the opening in the whipstock.
Figure 2B:
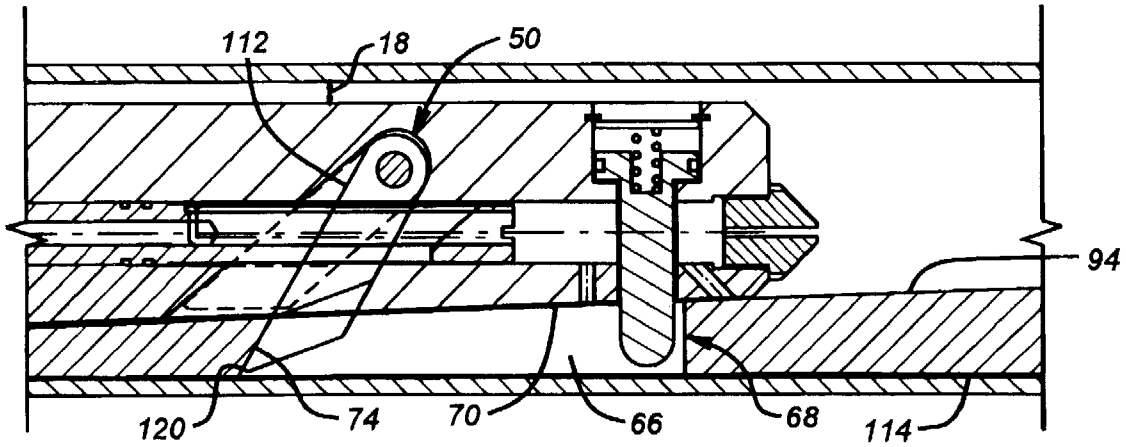
Figure 4:
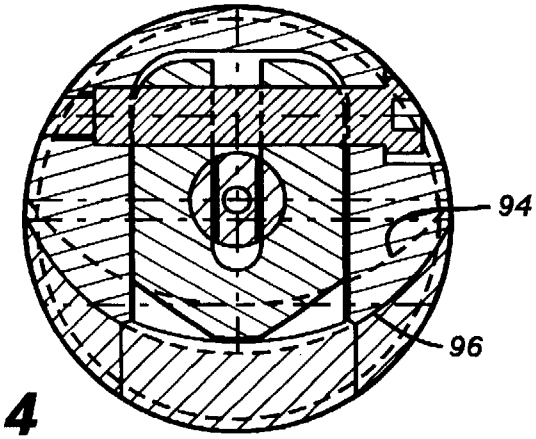
FIG. 4 is a sectional view through the retrieving tool in the area of the latch with the latch in the retracted position.

As seen in FIGS. 1*c* and 1*d*, the whipstock 64 has an opening 66 with a tapered upper edge 74. Referring again to FIG. 5, it can be seen that the profile of the latch 50 includes side tapers. The tapers 76 and 78 are cut onto latch 50 at a particular angle such that when latch 50 slides against surfaces 70 or 76 and is then pulled forward to the position shown in solid lines in FIG. 2*b*, the latch 50 is guided easily into alignment with and firmly under tapered surface 74, as shown in FIG. 2*b*. FIG. 4 is merely the view of FIG. 5 with the latch 50 in the retracted position of FIG. 1*d*. Latch 50 may be released when it is beyond opening 66. Upon pulling up body 18 latch 50 will be biased into opening 66 by spring 30 acting on piston 22.

An examination of the body 18 also reveals washports 80 and 82 as well as nozzle 60 which has an outlet 84. When fluid is pumped from the surface to increase the volume of variable volume cavity 34, thereby raising the piston 22 uphole away from nozzle 60, fluid also flows through ports 80 and 82 and outlet 84 to dean debris off the whipstock 64 as the apparatus is advanced toward the whipstock 64 for engagement therewith. Accordingly, the opening 66 is flushed from a variety of sources prior to advancing body 18 further beyond the position shown in FIG. 1*d* to initiate the latching operation.

To understand the operation of the latching mechanism, it should be noted that the body 18 is advanced with latch 50 retracted, preferably fully, into cutout 86 which is defined by upper tapered surface 88 and lower tapered surface 90. When pressure is applied to cavity 34, the upper limit of travel of piston 22 occurs as lugs 56 and 58 rotate latch 50 until it engages upper tapered surface 88. At that point as seen in FIG. 1*d*, the lower end 92 is ensconced within cutout 86. Accordingly, as the apparatus A is being lowered into the wellbore, the latch 50 is extended but remains within an effective diameter of body 18 so it will not catch on obstructions or protrusions in the wellbore on its way down to the whipstock 64.

Figure 7:
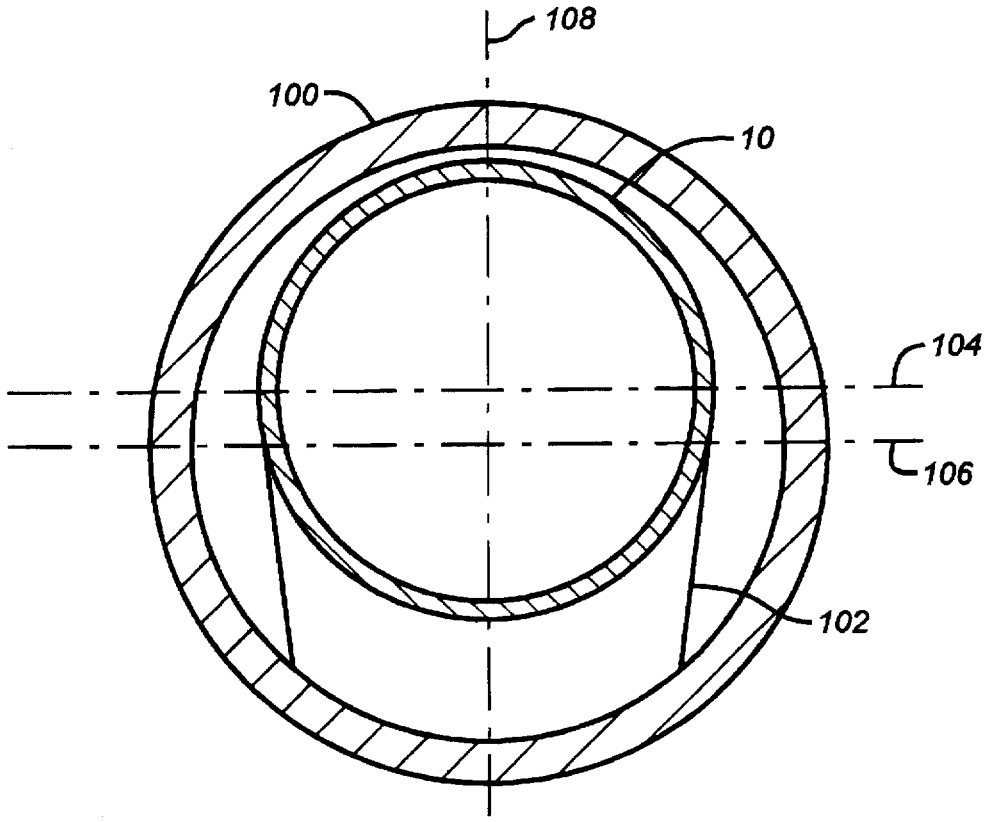
FIG. 7 is a section view of the offset stabilizer.
Figure 8:
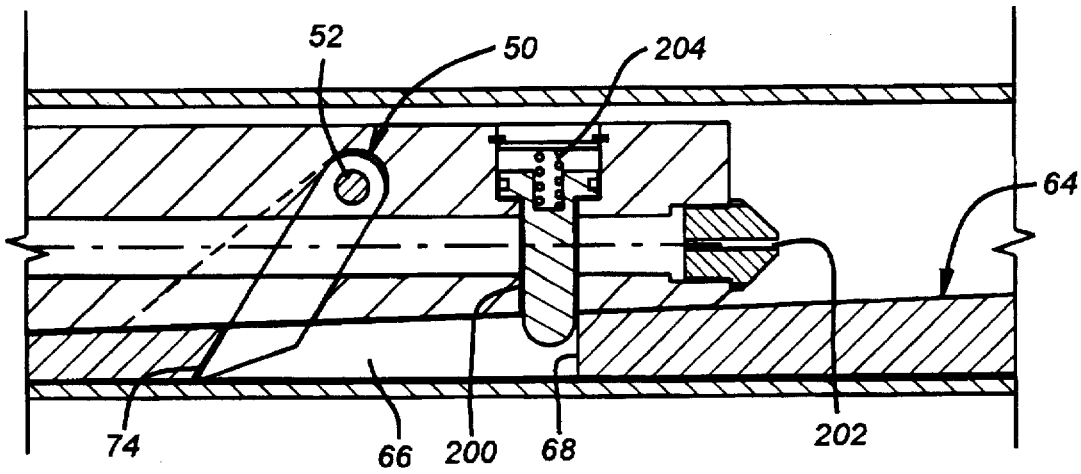
FIG. 8 is a detailed view of FIG. 1*d* with the latch pin in the extended position.
Figure 9:
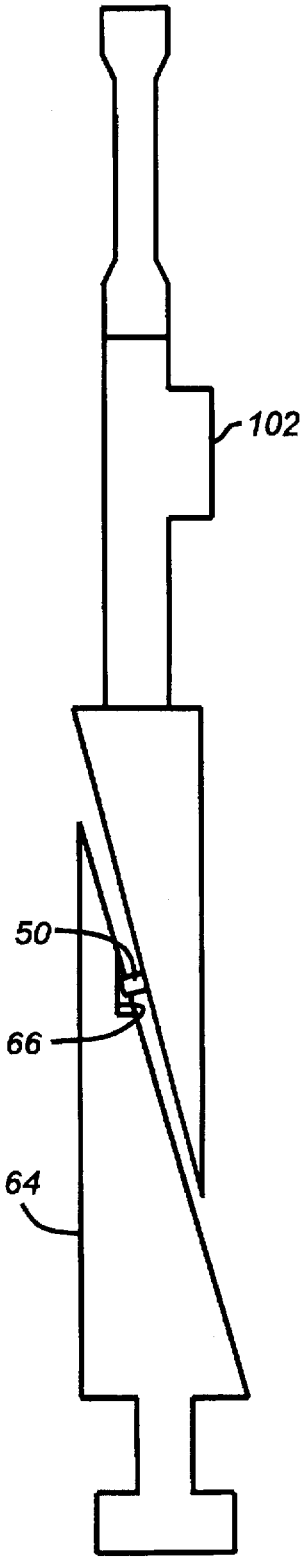
FIG. 9 is a sectional elevational view showing the positioning of the eccentric stabilizer and its flexible mounting to the retrieving tool.

Continuing with the latching operation, the apparatus A is brought down toward the whipstock 64. It could conceivably occur that the mating profile 94 aligns itself perfectly with the crescent-shaped profile of whipstock 64. The crescent-shaped surface 96 is illustrated in FIGS. 4 and 5. However, the probability of perfect alignment upon lowering the body 18 adjacent the whipstock 64 is quite small. It is quite possible that the lower end 98 of body 18 could approach the crescent-shaped surface 96 of whipstock 64 in a turned or misaligned position such that the mating profile 94 is not in the alignment as shown in FIGS. 4 and 5. This is a situation that could result in sticking or jamming of the body 18 between the casing 100 and the crescent-shaped surface 96 on whipstock 64. In order to avoid this situation, the offset stabilizer 102 has been developed and incorporated into top sub 10 as shown in FIG. 1*a*. The offset stabilizer 102 is also shown in section in FIG. 7. With the offset stabilizer 102 the center line of top sub 10, indicated by dashed line 104, is displaced from the central line of the casing 100, indicated by a dashed line 106. The offset stabilizer 102 is centered about axis 108 which is shown also in the cross-section of FIG. 5 indicating that the offset stabilizer 102 is in alignment with the plane of pivoting of latch 50 about pivot 52. Plainly, if the body 18 is angularly offset from the necessary position illustrated in FIGS. 4 and 5, the lower end 98 will strike the upper end 110 of the whipstock 64. The operating personnel at the surface generally know the approximate location of the whipstock 64. Accordingly, they will readily know if the lower end 98 of body 18 has struck the upper end 110 of whipstock 64. In that event, the operating personnel need only to slowly rotate to bring the mating profile 94 into alignment with the crescent-face 96 of whipstock 64. A flexible member run above the eccentric stabilizer assists in creating a fulcrum point, resulting in a force being created to assist in latching the retrieving tool to the whipstock slot. Orientation can also be assisted by gyro MWD or other survey devices. Any potential sticking of the body 18 between casing 100 and whipstock 64 is eliminated by the offset stabilizer 102.

After using the offset stabilizer 102 to secure the proper alignment, the body 18 is advanced so that cutout 86 passes beyond tapered lower edge 68 of opening 66. At that point, the pressure in bore 16 and cavity 34 is removed. Spring 30 then biases piston 22. Piston 22 then pushes on latch 50 to rotate it counterclockwise toward crescent-shaped surface 94. At that point in time the latch 50 cannot fully rotate because the body 18 has been brought down too far and the rotation ends when the lower end 92 engages the crescent-shaped surface 94. Thereafter, by bringing up the body 18, the spring 30 continues to bear on piston 22 which continues to rotate the latch 50 counterclockwise as it slides into pocket 66. Pin 200 which had been held retracted due to a backpressure created by orifice 202 resulting in compression of spring 204, can now spring out when the back-pressure is removed and pin 200 aligns with opening 66. This occurs as latch 50 abuts surface 74 in opening 66. The whipstock is now positively retained and will not be released unless backpressure again retracts pin 200. Body 18 can be pulled up further until the leading edge 112 contacts the leading end 74 of opening 66 as shown in FIG. 2*b*. At this point the latch 50 is locked to the whipstock 64. It should be noted that the counterclockwise rotation of latch 50 upon removal of hydraulic pressure from cavity 34 and upon its further insertion into the opening 66 is limited by lugs 56 and 58 so that the opposed grooves 76 and 78 are disposed in the proper plane for alignment for lugs 70 and 72. In essence, the latch 50 assumes the position shown in the solid line in FIG. 2*b* from the time the latch 50 clears tapered lower edge 68 as the body 18 is raised. Once the position shown in FIG. 2*d* is assumed, there is not enough space within the casing 100 to allow sufficient angular counterclockwise rotation of latch 50 so that it may let go of the whipstock 64. If for any reason a normal release is desired the pressure must be reinstated into cavity 34 and with the whipstock temporarily supported, the body 18 is moved down at which point the latch 50 can retract by clockwise rotation into the position shown in FIG. 1*d*.

A possibility exists that as the apparatus A moves uphole the size of the casing, such as 100, gets larger. With the design shown in FIGS. 2*a–b*, should the casing become enlarged and the whipstock on the trip out of the hole be temporarily rested on a ledge or other protrusion in the wellbore, setting down weight on the body 18 does not allow sufficient room for an unlatching.

Figure 3A:
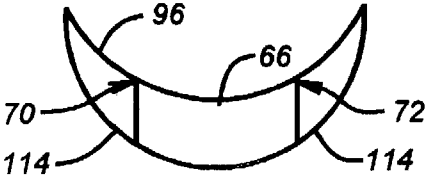
FIG. 3*a* is a transverse sectional view of the opening in the whipstock showing the crescent profile of the whipstock.
Figure 3B:
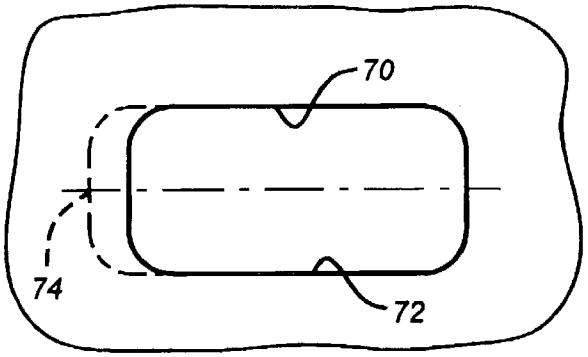
FIG. 3*b* is a view looking down into the opening of the whipstock.

FIG. 3 illustrates a section through the upper end of the whipstock 64 illustrating the shape of the opening 66 with the comers 70 and 72. FIG. 3*b* illustrates the plane view as compared to FIG. 3*a* illustrating how the latch 50 interacts with upper tapered surface 74.

Figure 6A:
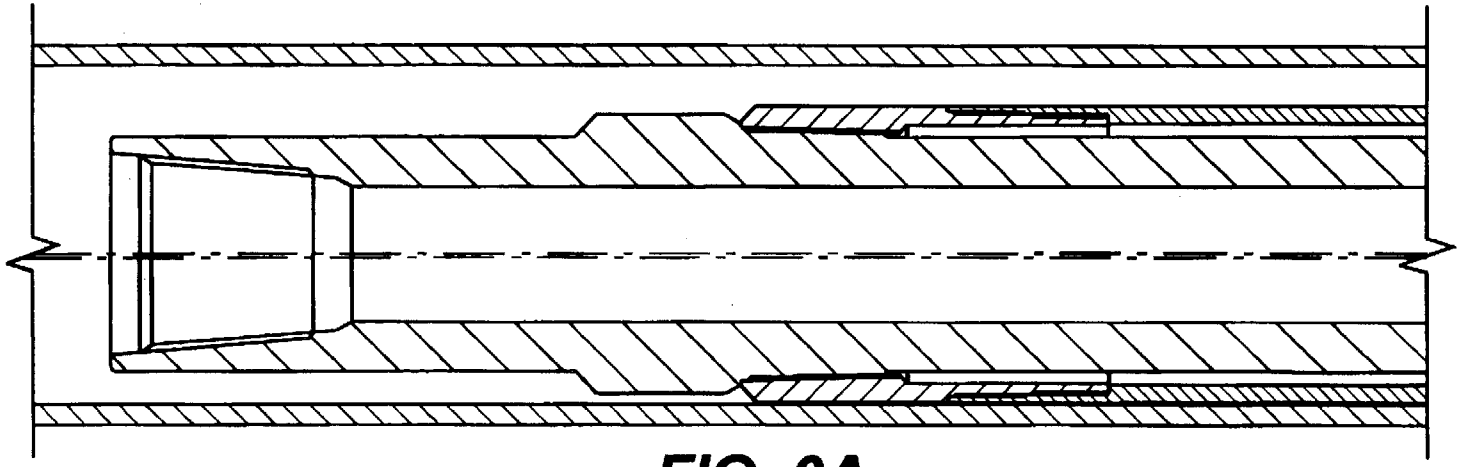
FIGS. 6*a–c* are an alternative embodiment using similar latch actuation components but illustrating, in a sectional elevational view, an overshot design which grips the whipstock without need of entry into an opening within the whipstock.
Figure 6B:
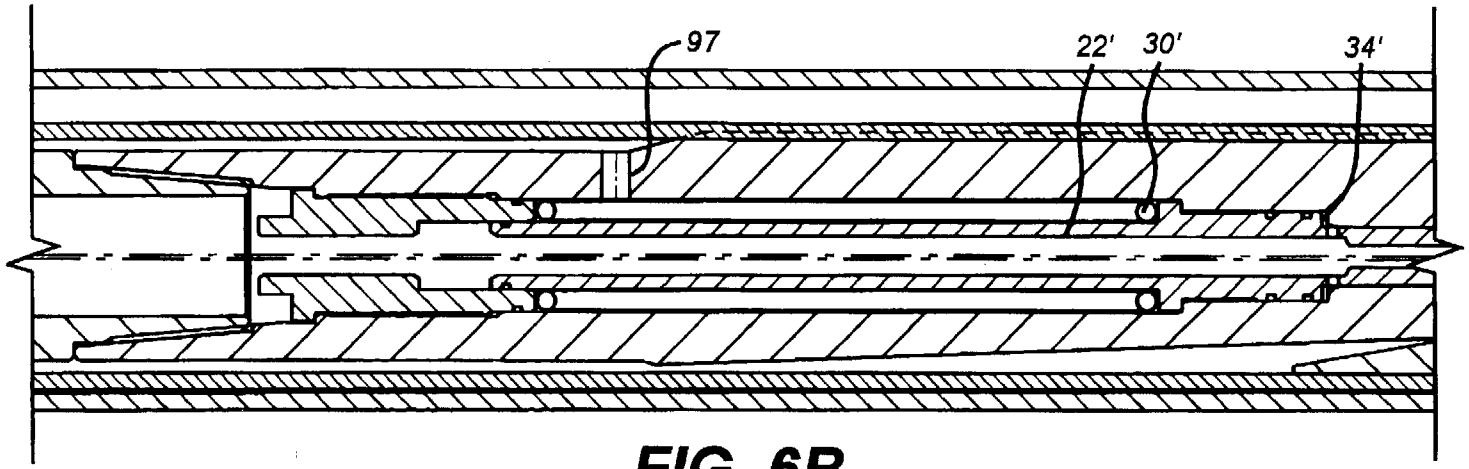
Figure 6C:
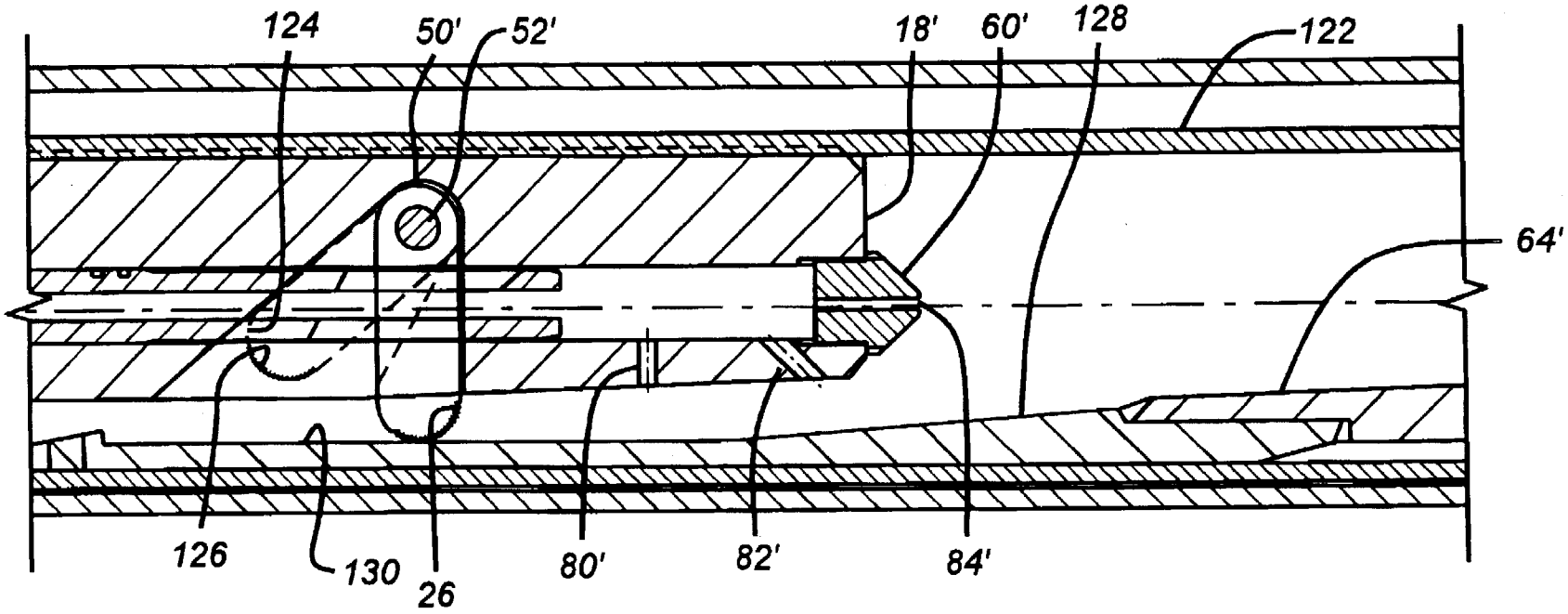

FIGS. 6*a–c* illustrate an alternative embodiment to the embodiment previously described. The principal components regarding the actuation of the latch 50 are similar and will not be again described. In the design shown in FIGS. 6*a–c*, the body 18' is covered by an outer or oversleeve 122 which pushes itself behind the whipstock 64'. The latch 50' is again rotatable about pivot 52'; however, its lower end 124 is curved and has a series of jagged teeth 126. The retracted position is shown in dashed lines in FIG. 6*c*. The extended position shown in FIG. 6*c* is the ultimate travel stop position of latch 50 if it were released well above the whipstock 64'. However, in the position where the pivot 52' is juxtaposed adjacent to the extension segment 128, the angular movement in a counterclockwise direction from the dashed line position of FIG. 6*c* until contact with surface 130 does not involve the degree of angular rotation shown in the solid line view in FIG. 6*c*. The operation of the embodiment of FIG. 6 again indicates that hydraulic pressure is applied to cavity 34' thus putting the latch 50' in the dashed line position of FIG. 6*c* with the body 18' properly positioned over the whipstock 64' the pressure in cavity 34' is removed to allow spring 30 to push the piston 22' toward nozzle 60'. Ultimately, the teeth 126 wedge against the surface 130 and an upward pull from the surface bringing up body 18' retrieves the whipstock 64'. This occurs because the pivot 52' is further downhole from the free end 92' of latch 50'. After contact teeth 126 are forced counterclockwise to wedge against surface 130. It should be noted that in the embodiment of FIG. 6 the feature of using an offset stabilizer is not necessary in view of the use of sleeve 122. Similarly, by employing the sleeve 116 as shown in FIG. 4 to the embodiment shown in FIG. 1 the necessity or desirability of use of the offset stabilizer 102 is eliminated. This occurs because the possibility of a misalignment on insertion causing a wedging cannot occur if the apparatus A winds up straddling the upper end 110 of the whipstock 64. In essence, there is only one orientation that will allow the straddle to take place when using a sleeve such as 116.

The tools illustrated in FIGS. 1 and 6 can be used interchangeability. Alternatively, the tool of FIGS. 1*a–d* can be used to try and retrieve the whipstock 64. If for any reason the opening 66 has not been cleared of debris despite the washing action or in the event where the milling of a window in the casing 100 has resulted in physical damage to the opening 66 to prevent the entry of the latch 50 into the opening 66, the tool of FIG. 6 can be used behind the tool of FIG. 1 if the tool of FIG. 1 has been unsuccessful in retrieving the whipstock 64. It is clear from looking at FIG. 6 that no opening 66 is required in the extension segment 128. All that is necessary is the ability to rotate the latch 50' into a gripping contact with a portion of the whipstock 64' so that it can be retrieved to the surface. Again, even when using the rounded bottom 124 design of the latch 50', the washing action through ports 80', 82', and 84' helps to prepare and condition the surface 130 for a good bite of teeth 126.

Those skilled in the art will appreciate that the apparatus and method described above presents many improvements over prior techniques for retrieval of whipstocks. The washing action disclosed by this invention helps to condition the appropriate whipstock surfaces to facilitate the engagement of the latch 50 or 50'. The use of the offset stabilizer 102 prevents jamming and assures with a very simple design appropriate alignment for the latching and retrieval. The latch 50 and 50' may be run-in in a retracted position which avoids sticking it unintentionally on any projections or protrusions within the wellbore and/or the casing therein. Its reverse orientation further reduces a risk of damage to latch 50 or 50' during run-in should the latch be sticking out of body 18 even in the slightest amount. The apparatus and method is simple to use and automatically goes into a retracted position on the latch 50 or 50' when the circulation is initiated from the surface into bore 16. The latch 50 or 50' is held retracted until after it passes the desired opening 66. At that time it is released and automatically put into alignment. At that point, unless hydraulic pressure is again applied to bore 16 inadvertent normal release from a casing of a given size is not possible. To further assure against accidental release even in casing of a larger size than the casing at the depth that the whipstock 64 is secured, a sleeve 122 in the design of FIG. 6 can be employed.

While the detailed description of the preferred embodiment has illustrated an application of the apparatus and method to the retrieval of a whipstock 64, other objects could conceivably be retrieved from the wellbore with the apparatus without departing from the spirit of the invention.

The foregoing disclosure and description of the invention are illustrative and explanatory thereof, and various changes in the size, shape and materials, as well as in the details of the illustrated construction, may be made without departing from the spirit of the invention.

We claim:

1. An apparatus for retrieving a whipstock, having a working face with an opening therein, comprising:

a body having an exposed tapered lower end presenting a mating face generally conforming to said working face of said whipstock said body comprising a movably mounted actuator piston; and said body further comprising a latch assembly comprising a pivotally latch selectively driveable by said actuator piston in opposed directions between a first position, where it is retracted substantially toward said body, and a second position where it extends sufficiently away from said body to enter said opening in said whipstock.

2. The apparatus of claim 1, wherein:

said latch is actuable by fluid pressure applied to said piston; and said body further comprising at least one port to allow applied fluid pressure in said body to create a flow of fluid through said port to clean the whipstock prior to an attempt to retrieve it.

3. The apparatus of claim 1, further comprising:

an offset orientation device on said body above said mating face on said lower end to prevent said exposed tapered lower end of said body from advancing past the whipstock in the wellbore if said mating face is not in substantial alignment with the working face of the whipstock.

4. The apparatus of claim 1, wherein:

said latch is held in said first position by fluid pressure applied to said piston connected thereto; and said latch enabled to rotate away from said mating face toward a second position when said piston is biased upon removal of said fluid pressure.

5. The apparatus of claim 1, further comprising:

a lock member disposed apart from said latch; and said lock member precluding relative movement between said body and the whipstock when extending into the opening of the whipstock with said latch.

6. The apparatus of claim 5, wherein:

said lock member is defeated by application of said fluid pressure and is biased toward the opening in the whipstock upon removal of said fluid pressure.

7. The apparatus of claim 3, wherein:

said offset orientation device comprises a lateral projection on said body in substantial angular alignment with said mating face on said body to effectively prevent said body from passing over any portion of the whipstock until said mating and the working faces are in substantial alignment.

8. The apparatus of claim 2, wherein:

said body comprises a plurality of ports to wash with fluid the working face and opening therein prior to attempting to insert said latch in the opening on the whipstock.

9. The apparatus of claim 1, wherein:

said latch is held in said first position by fluid pressure applied to said piston connected thereto; and said latch enabled to rotate away from said mating face toward a second position when said piston is biased upon removal of said fluid pressure.

10. The apparatus of claim 9, wherein:

a lock member disposed apart from said latch; and said lock member precluding relative movement between said body and the whipstock when extending into the opening of the whipstock with said latch.

11. The apparatus of claim 10, wherein:

said lock member is defeated by application of said fluid pressure and is biased toward the opening in the whipstock upon removal of said fluid pressure.

12. A tool for retrieving a whipstock having a working face and an opening thereon, comprising:

a body having a mating face generally conforming to the working face of the whipstock;

said body further comprises a latch assembly comprising a movable latch selectively operable between a first position, where it is retracted substantially toward said mating surface, and a second position, where it extends sufficiently outwardly from said mating surface to enter the opening of the whipstock for its removal; and a lock mechanism disposed apart from said latch and operable to trap said latch in the opening of said whipstock to selectively secure its grip of the whipstock.

13. The apparatus of claim 12, wherein:

said latch is held in said first position by fluid pressure applied to a piston;

said piston biased to extend said latch by pivoting it upon removal of fluid pressure; and said lock mechanism biased to extend toward the whipstock upon removal of fluid pressure.

14. The apparatus of claim 13, wherein:

said latch and said locking mechanism enter the opening in the whipstock upon removal of fluid pressure.

15. The apparatus of claim 14, wherein:

said latch and said lock mechanism cannot normally release from said working face unless fluid pressure is applied to overcome said biasing of said piston.

16. The apparatus of claim 15, wherein:

said body comprises at least one port to allow the fluid pressure used to keep said latch in said first position and at the same time to create a cleaning flow through said port prior to an attempt to engage the whipstock with said latch.

17. A method for retrieving a whipstock, comprising:

providing a retrieving tool with a body having an exposed tapered profile on its lower end substantially matching a profile on the whipstock;

retracting a latch toward said body for run-in;

providing an alignment member above said exposed tapered profile to preclude misalignment between the profiles of the retrieving tool and the whipstock;

releasing the latch upon said aligning; and securing the whipstock to said retrieving tool.

18. The apparatus of claim 17, further comprising:

providing fluid pressure to said retrieving tool to retract said latch;

creating fluid flow through at least one port in said retrieving tool with said applied fluid pressure; and cleaning the whipstock with said flow prior to actuation of said latch for engagement.

19. The method of claim 18, further comprising:

preventing, with said alignment member, advancement of said tapered profile of said retrieving tool past any portion of the tapered profile of the whipstock unless the tapered profiles are in substantial alignment.

20. The method of claim 17, further comprising:

holding said latch retracted with fluid pressure;

releasing said latch to pivot by removal of said pressure; and allowing said latch to pivot into an opening in the whipstock.

21. The method of claim 17, further comprising:

using a piston to pivot said latch; and pivoting said latch into contact with said whipstock to secure the whipstock against said tool.

22. The method of claim 21, further comprising:

using fluid pressure to hold said latch retracted;

using a biasing force to extend said latch by rotation upon removal of said fluid pressure;

using removal of fluid pressure to actuate a locking member; and positioning said latch against said whipstock in a manner which requires reapplication of fluid pressure to said piston to overcome said biasing for a normal release.

23. The method of claim 17, further comprising:

preventing, with said alignment member, advancement of said tapered profile of said retrieving tool past any portion of the tapered profile of the whipstock unless the tapered profiles are in substantial alignment.

24. The method of claim 19, further comprising:

holding said latch retracted with fluid pressure;

releasing said latch to pivot by removal of said pressure; and allowing said latch to pivot into an opening in the whipstock.

25. A method for retrieving a whipstock, comprising:

providing a retrieving tool with a body having a tapered profile matching the whipstock;

retracting a latch toward said body for run-in;

aligning the profiles of the retrieving tool with the whipstock;

holding said latch retracted with fluid pressure;

releasing said latch to pivot by removal of said pressure upon said aligning;

allowing said latch to pivot into an opening in the whipstock;

securing the whipstock to said retrieving tool;

providing a locking member on said body;

allowing the locking member to enter the opening in the whipstock; and locking said latch to said opening by virtue of said locking member entering the opening.

26. The method of claim 25, further comprising:

providing a reverse angle to the opening in the whipstock;

providing a travel stop to said latch to orient it approximately parallel to said reverse angle; and allowing said locking member to enter the opening at the opposite end from said latch upon said latch coming near to said reverse angle on the opening.

27. The method of claim 26, further comprising:

using a biased piston to pivot said latch;

configuring said body, said latch, and said locking member so as to require reapplication of fluid pressure to said piston to overcome said biasing to secure normal release.

28. A method for retrieving a whipstock, comprising:

providing a retrieving tool with a body having a tapered profile matching the whipstock;

retracting a latch toward said body for run-in;

aligning the profiles of the retrieving tool with the whipstock;

releasing the latch upon said aligning;

securing the whipstock to said retrieving tool;

providing fluid pressure to said retrieving tool to retract said latch;

creating fluid flow through at least one port in said retrieving tool with said applied fluid pressure;

cleaning the whipstock with said flow prior to actuation of said latch for engagement;

providing a lateral projection on said body of said retrieving tool;

preventing, with said projection, advancement of said tapered profile of said retrieving tool past any portion of the tapered profile of the whipstock unless the tapered profiles are in substantial alignment;

holding said latch retracted with fluid pressure;

releasing said latch to pivot by removal of said pressure;

allowing said latch to pivot into an opening in the whipstock;

providing a locking member on said body;

allowing the locking member to enter the opening in the whipstock;

locking said latch to said opening by virtue of said locking member entering the opening.

29. The method of claim 28, further comprising:

providing a reverse angle to the opening in the whipstock;

providing a travel stop to said latch to orient it approximately parallel to said reverse angle;

allowing said locking member to enter the opening at the opposite end from said latch upon said latch coming near to said reverse angle on the opening.

30. The method of claim 29, further comprising:

using a biased piston to pivot said latch;

configuring said body, said latch, and said locking member so as to require reapplication of fluid pressure to said piston to overcome said biasing to secure normal release.

31. A tool for retrieving a whipstock, having a working face thereon, comprising:

a body having a mating face generally conforming to the working face of the whipstock and an over sleeve such that upon advancement of said body the whipstock aligns between said mating face and said over sleeve; and said body further comprises a piston connected to a movable latch comprising a single pivotally mounted link selectively rotatable by said piston between first position where it is retracted substantially toward said mating surface and a second position where it extends sufficiently outwardly from said mating surface to get a grip on the working face of the whipstock for its removal.

32. The apparatus of claim 31, wherein:

said latch is held in said first position by fluid pressure applied to said piston; and said piston biased to extend said latch by pivoting it upon removal of fluid pressure.

33. The apparatus of claim 32, wherein:

said latch has a gripping device which contacts the working face of the whipstock upon counterclockwise rotation; and whereupon application of an extraction force to said body said piston exerts a wedging force on said latch forcing said whipstock against said oversleeve for retention thereof.

34. The apparatus of claim 33, wherein:

said latch cannot normally release from said working face unless fluid pressure is applied to overcome said biasing of said piston.

35. The apparatus of claim 34, wherein:

said body comprises at least one port to allow the fluid pressure used to keep said latch in said first position and at the same time to create a cleaning flow through said port prior to an attempt to engage the whipstock with said latch.

36. The apparatus of claim 33, wherein:

said latch has a rounded free end with a plurality of teeth for gripping and wedging the whipstock.

37. An apparatus for retrieving a whipstock, having a working face with an opening therein, comprising:

a body having a mating face generally conforming to said working face of said whipstock; and said body further comprising a latch assembly comprising a movable latch selectively operable between a first position, where it is retracted substantially toward said body, and a second position where it extends sufficiently away from said body to enter said opening in said whipstock said latch is actuable by fluid pressure applied to said body;

said body further comprising at least one port to allow applied fluid pressure in said body to create a flow of fluid through said port to clean the whipstock prior to an attempt to retrieve it;

said latch is held in said first position by fluid pressure applied to a piston connected thereto;

said latch enabled to rotate away from said mating face toward a second position when said piston is biased upon removal of said fluid pressure;

said latch assembly further comprises a lock member;

the opening in the whipstock is formed to accept said lock member to secure the latching;

said lock member is defeated by application of said fluid pressure and is biased toward the opening in the whipstock upon removal of said fluid pressure; and said lock member enters the opening in the whipstock upon said latch reaching near the opposite end of said opening from said lock member.

38. An apparatus for retrieving a whipstock, having a working face with an opening therein, comprising:

a body having a mating face generally conforming to said working face of said whipstock; and said body further comprising a latch assembly comprising a movable latch selectively operable between a first position, where it is retracted substantially toward said body, and a second position where it extends sufficiently away from said body to enter said opening in said whipstock said latch is actuable by fluid pressure applied to said body;

said body further comprising at least one port to allow applied fluid pressure in said body to create a flow of fluid through said port to clean the whipstock prior to an attempt to retrieve it;

said latch is held in said first position by fluid pressure applied to a piston connected thereto;

said latch enabled to rotate away from said mating face toward a second position when said piston is biased upon removal of said fluid pressure;

said latch assembly further comprises a lock member;

the opening in the whipstock is formed to accept said locking member to secure the latching;

said lock member is defeated by application of said fluid pressure and is biased toward the opening in the whipstock upon removal of said fluid pressure; and said lock member enters the opening in the whipstock upon said latch reaching near the opposite end of said opening from said lock member.

39. A tool for retrieving a whipstock having a working face and an opening thereon, comprising:

a body having a mating face generally conforming to the working face of the whipstock;

said body further comprises a latch assembly comprising a movable latch selectively operable between first position, where it is retracted substantially toward said mating surface, a second position, where it extends sufficiently outwardly from said mating surface to get a grip on the working face of the whipstock for its removal;

said latch assembly further comprising a lock mechanism operable in conjunction with said latch to selectively secure its gripping position of the whipstock;

said latch is held in said first position by fluid pressure applied to a piston;

said piston biased to extend said latch by pivoting it upon removal of fluid pressure;

said lock mechanism biased to extend toward the whipstock upon removal of fluid pressure;

said latch and said locking mechanism enter the opening in the whipstock upon removal of fluid pressure; and said latch enters the opening near an end opposite to where said lock mechanism enters to secure the attachment.

* * * * *